US007257359B2

(12) United States Patent
Soures et al.

(10) Patent No.: US 7,257,359 B2
(45) Date of Patent: Aug. 14, 2007

(54) TRANSFER ASSIST BLADE DWELL CORRECTION

(75) Inventors: Michael N. Soures, Webster, NY (US); David Kenneth Ahl, Rochester, NY (US); Robert Arnold Gross, Penfield, NY (US); Michael W. Schab, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 239 days.

(21) Appl. No.: 11/209,556

(22) Filed: Aug. 23, 2005

(65) Prior Publication Data

US 2007/0048034 A1 Mar. 1, 2007

(51) Int. Cl.
*G03G 15/16* (2006.01)

(52) U.S. Cl. ..... 399/316

(58) Field of Classification Search ..... 399/316
See application file for complete search history.

(56) References Cited

U.S. PATENT DOCUMENTS 5,298,954 A 3/1994 Fujita et al.
5,923,921 A * 7/1999 OuYang et al. ..... 399/66
6,327,445 B1 12/2001 Honda et al.
6,510,296 B2 1/2003 Less et al.
6,556,805 B1 4/2003 Kuo et al.
6,687,480 B2 2/2004 Obrien et al.
6,845,224 B1 1/2005 Gross et al.
2003/0108369 A1 * 6/2003 Kuo et al. ..... 399/310

FOREIGN PATENT DOCUMENTS

JP 05210318 A * 8/1993
JP 06059582 A * 3/1994

* cited by examiner

*Primary Examiner*—Quana Grainger
(74) *Attorney, Agent, or Firm*—Maginot, Moore & Beck

(57) ABSTRACT

An apparatus for assisting in the transfer of an image from an image bearing member onto a copy substrate, comprises an image bearing member carrying an image to be transferred, a feed mechanism for feeding a copy substrate to the image bearing member, and a transfer assist mechanism movable to an activated position bearing on the substrate to maintain the substrate in contact with the image bearing member to assist in transferring the image thereto, and to a de-activated position. A sensor generates a signal in response to passage of the leading edge and the trailing edge of the substrate to ascertain an actual length of the substrate as it moves to the image bearing member. A controller is operable to direct the transfer assist mechanism to move to the activated position and then to direct the transfer assist mechanism to move to the de-activated position after a de-activation dwell time. The de-activation dwell time is at least initially a nominal dwell time based on an expected length of the substrate from its leading edge to its trailing edge. The controller is operable to change the de-activation dwell time from the nominal dwell time in response to the determination of the actual length of the substrate.

12 Claims, 3 Drawing Sheets

TRANSFER ASSIST BLADE DWELL CORRECTION

TECHNICAL FIELD

The present disclosure relates generally to a copier or printing system, and, more specifically, concerns a method for adjusting the timing of a subsystem that assists the transfer of a toned image from an imaged surface to a copy substrate.

BACKGROUND AND SUMMARY

The function of transfer assist blades is generally for pressing a copy substrate into intimate contact with the toner particles on a selectively charged imaging surface, such as a photoreceptor, during image transfer from the charged imaging surface onto the copy substrate. In particular, non-flat or uneven image support substrates, such as copy sheets that have been mishandled, paper that has been left exposed to the environment, or substrates that have previously passed through a fixing operation (for example, heat and/or pressure fusing) often tend to yield imperfect contact with the photoconductive surface. Some printing applications require imaging onto high quality papers having surface textures which prevent intimate contact of the paper with the developed toner images. In duplex printing systems, even initially flat paper can become cockled or wrinkled as a result of paper transport and/or the first side fusing step. Also, color images can contain areas in which intimate contact of toner with paper during the transfer step is prevented due to adjacent areas of high toner pile heights.

The lack of uniform intimate contact between the imaging surface and the copy sheet in these situations can result in spaces or air gaps between the developed toner powder image on the selectively charged imaging surface and the copy substrate. When spaces or gaps exist between the developed image and the copy substrate, various problems may result. For example, there is a tendency for toner not to transfer across gaps, causing variable transfer efficiency and, under extreme circumstances, creating areas of low toner transfer or even no transfer, resulting in a phenomenon known as image transfer deletion.

In order to minimize transfer deletions, transfer assist blades (TABs) have been utilized to press the back of the copy substrate against the imaged area of the charged imaging surface. The transfer assist blade is typically moved from a non-operative position spaced from the copy substrate, to an operative position in contact with the copy substrate. A mechanism supporting the TAB is operable to press the TAB against the copy sheet with a typically pre-determined force sufficient to press the copy substrate into contact with the developed image on the photoconductive or other charged imaging surface in order to substantially eliminate any spaces therebetween during the transfer process.

For a number of reasons, no portion of the transfer assist blade should contact the imaging surface. Such contact may result in the pick up of residual dirt and toner from the charged imaging surface onto the portion of the transfer assist blade that contacts the imaging surface. More significantly, contact of the TAB with the charged imaging surface risks abrading the surface, thereby adversely affecting subsequent image quality and shortening the expected life of the expensive photoreceptor or other charged imaging surface.

In order to ensure that a transfer assist blade does not contact the imaging surface beyond the sides of the copy substrate perimeter, either the transfer assist blade is shortened to correspond to the narrowest copy sheet width expected to be processed in the printer, or the effective length of the transfer assist blade is varied to correspond to the width of the substrate. An apparatus such as that disclosed in U.S. Pat. No. 6,687,480, issued to Obrien et al., is capable of varying the effective length of the transfer assist blade to account for different substrate widths.

As explained above, it is important that the TAB be raised and lowered so as not to contact the photoreceptor or other charged imaging surface when the substrate is not in contact with the TAB. As a counterpoint, it is also important that the TAB contact the back of the copy substrate as close as possible to the leading and trailing edges of the copy substrate in order to ensure contact in all imaging areas. A high degree of accuracy is therefore required in timing engagement and disengagement of the TAB with the copy substrate. Such engagements and disengagements of the TAB are generally designed as timed sequences in relation to paper path speed and the sensed width in the paper path of the copy substrate. As an example, U.S. Pat. No. 6,556,805, issued to Kuo et al., teaches a method of activating TAB segments by rotating one or more cam shafts, thereby pressing the TAB into contact with the copy substrate when the appropriate cam lobe has been rotated. Another system for activating TAB motions is taught in U.S. Pat. No. 6,188,863, issued to Gross et al. Any number of other systems have been utilized and many more are possible.

In the typical cam system, there is a timing delay between commencement of rotation by the cam shaft and contact between the TAB and the copy substrate. Similarly, there is a timing delay between sensing of the leading or trailing edge of a copy substrate and actuation or deactivation of the cam shaft rotation or other mechanism that urges the TAB toward the copy substrate. Such timing sequences are typically handled during machine design and initial system calibration. Conventionally, the calibration is performed manually by such means as attaching an ink pad to the blade, measuring the length of the mark that the pad makes on the back of a copy sheet, and calculating the required adjustment time to achieve the desired length of such mark.

As printing system speeds increase, the speed of the copy substrate along the paper path increases, and TAB activation and deactivation must be timed more perfectly to ensure proper placing of the TAB as close as possible to the leading and trailing edges. Moreover, initial calibrations of the timing sequence may be obsoleted as components affecting the sequence are replaced over time with replacement components that vary slightly in response time, size, shape, etc. In particular, a replacement TAB can vary slightly in length, thickness, position within its mounting, and each of these factors may affect the timing of TAB contact with a copy substrate. Additionally, normal wear and tear and "settling in" of cams, motors, gears, photoreceptor belts, and other components can affect the precise timing sequence of TAB actuation apparatus. Additional calibrations are possible but typically require the time, expense, and labor of service and maintenance calls. It is advantageous for electrostatographic imaging systems utilizing TAB-type devices to have a timing adjustment system wherein the timing of TAB activation and deactivation is adjusted to account for any of the changes that may affect the TAB timing sequence.

In one such system, disclosed in U.S. Pat. No. 6,485,224 issued to Gross et al., there is provided an apparatus for adjusting the timing of contact between a transfer assist blade and a charged imaging surface in order that the timing be automatically adjusted within specifications. The apparatus comprises an imaging apparatus for developing a partially toned pattern having about 20 to about 80 percent coverage in a region of a charged imaging surface; a transfer assist blade movable between a position engaged with a surface and a position disengaged from the surface, and a drive device for imparting engagement and disengagement motion to the transfer assist blade. The drive device has an activation time for engaging the transfer assist blade with the surface and a deactivation time for disengaging the transfer assist blade from the surface. A toner area coverage measuring device measures the percentage of the partially toned region that is covered by toner and feeds data to a controller for adjusting the timing of activation of the drive device. In particular, the apparatus in the '224 patent utilizes the toner area coverage measuring device to determine whether the time of activation has resulted in engagement of the transfer assist blade outside of the specifications. If so, the controller automatically adjusts the timing of activation accordingly. The disclosure of the '224 patent is incorporated herein by reference, and especially the description of the TAB drive device and the controller.

In response to the needs left unmet by these prior systems, an apparatus is provided for assisting in the transfer of an image from an image bearing member onto a copy substrate that comprises an image bearing member carrying an image to be transferred, a feed mechanism for feeding a copy substrate to the image bearing member, and a transfer assist mechanism movable to an activated position bearing on the substrate to maintain the substrate in contact with the image bearing member to assist in transferring the image thereto, and to a de-activated position. A sensor generates a signal in response to passage of the leading edge and the trailing edge of the substrate to ascertain an actual length of the substrate as it moves to the image bearing member. A controller is operable to direct the transfer assist mechanism to move to the activated position and then to direct the transfer assist mechanism to move to the de-activated position after a de-activation dwell time. The de-activation dwell time is at least initially a nominal dwell time based on an expected length of the substrate from its leading edge to its trailing edge. The controller is operable to change the de-activation dwell time from the nominal dwell time in response to the determination of the actual length of the substrate.

A method is further provided for operating a transfer assist mechanism to bear on a substrate passing over an image bearing member for transferring an image onto the substrate. The method comprises activating the transfer assist mechanism to bear on the substrate, determining a nominal dwell time for de-activation of the transfer assist mechanism as a function of an expected length of the substrate, sensing an actual length of the substrate as it is conveyed to the image bearing member, and changing the dwell time for de-activation as a function of a comparison between the actual length and the expected length.

BRIEF DESCRIPTION OF THE DRAWINGS

Aspects and features of the present embodiments will become apparent as the following description proceeds and upon reference to the drawings, in which.

DESCRIPTION

Figure 1:
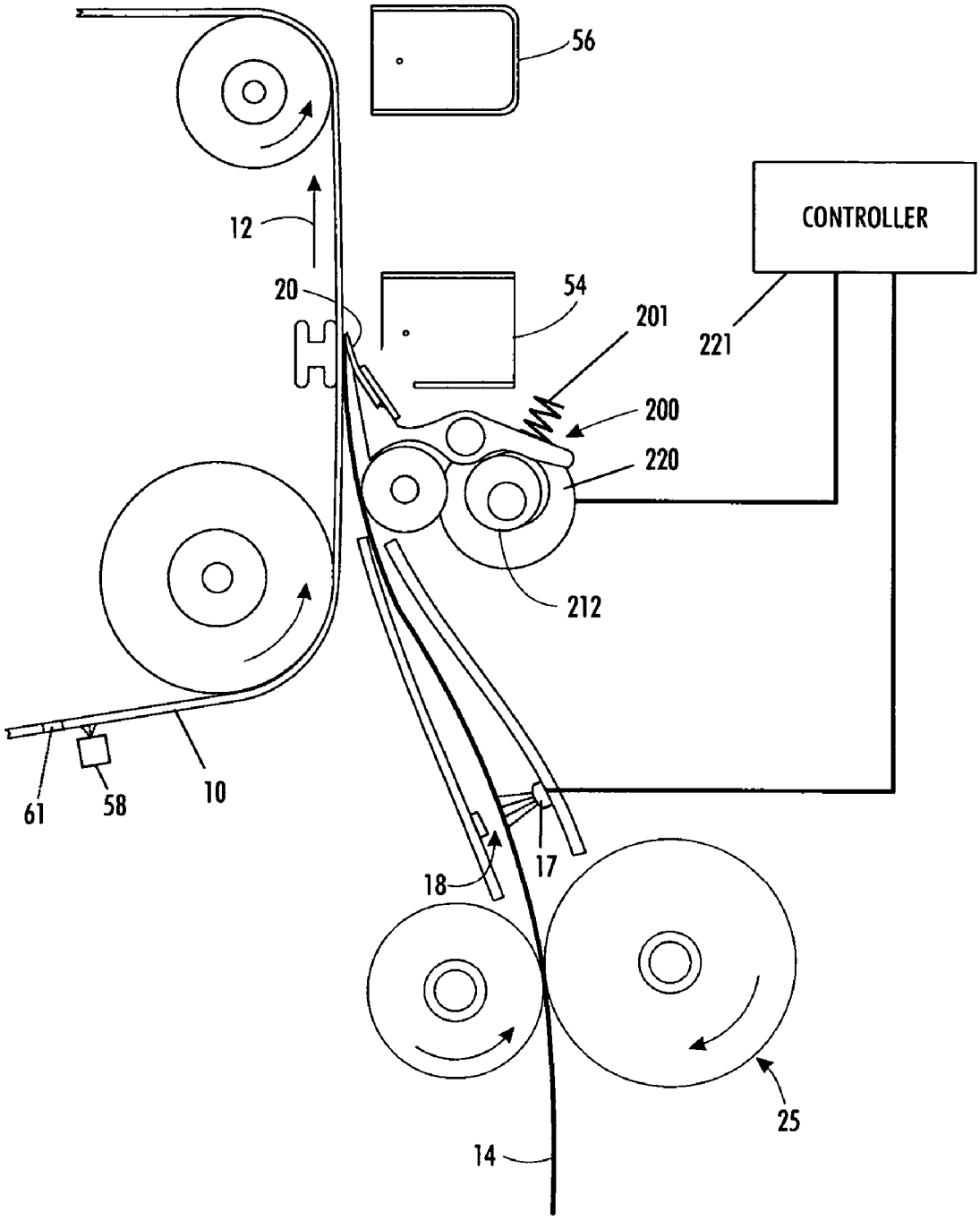
FIG. 1 is a schematic elevational view of a transfer assist blade and a partially toned region of a charged imaging surface.

For a general understanding of the present embodiments, reference is made to the drawings. In the drawings, like reference numerals have been used throughout to designate identical elements.

An exemplary imaging system comprising one embodiment of the present invention is a multifunctional printer with print, copy, scan, and fax services. Such multifunctional printers are well known in the art and may comprise print engines based upon liquid or solid ink jet, electrophotography, other electrostatographic technologies, and other imaging technologies. The general principles of electrophotographic imaging are well known to many skilled in the art and are described above as an exemplary embodiment of an imaging system to which the present invention is applicable.

A typical electrostatographic copying or printing process uses a photoconductive member that is charged to a substantially uniform potential, and the charged portion of the photoconductive member is subsequently exposed to a light image of a document being reproduced or printed. Exposure of the charged photoconductive member selectively dissipates the charge thereon in the irradiated areas so as to record on the photoconductive member an electrostatic latent image corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image to form a toner powder image on the photoconductive member. The toner powder image is then transferred from the surface of the photoconductive member to a copy substrate such as a sheet of paper. Thereafter, heat or some other treatment is applied to the toner particles to permanently affix the powder image to the copy substrate. In a final step in the process, the photoconductive surface layer of the photoreceptive member is cleaned to remove any residual developing material therefrom, in preparation for successive imaging cycles.

The process of transferring charged toner particles from an image bearing member such as the photoconductive member to an image support substrate such as the copy sheet is enabled by overcoming adhesive forces holding the toner particles to the image bearing member. Typically, transfer of developed toner images in electrostatographic applications is accomplished via electrostatic induction using a corona generating device, wherein the image support substrate is placed in direct contact with the developed toner image on the photoconductive surface while the reverse side of the image support substrate is exposed to a corona discharge for generating ions having a polarity opposite that of the toner particles, to electrostatically attract the toner particles from the photoreceptive member and transfer the toner particles to the image support substrate.

As described, the typical process of transferring development materials in an electrostatographic system involves the physical detachment of charged toner particles from a selectively charged image bearing surface and transfer of such charged particles to an image support substrate via electrostatic force fields. A critical aspect of the transfer process involves the application and maintenance of high intensity electrostatic fields in the transfer region for overcoming the adhesive forces acting on the toner particles as they rest on the surface of the selectively charged imaging member. In addition, other forces, such as mechanical pressure or vibratory energy, have been used to support and enhance the transfer process. Careful control of electrostatic fields and other forces is essential for inducing the physical detachment and transfer of the charged toner particles without scattering or smearing of the developer material. Such scattering or smearing may result in an unsatisfactory output image.

Referring to FIG. 1, an exemplary TAB embodiment within the copy transfer section of an electrostatographic imaging device is shown. As noted above, many varieties of TAB systems are possible, and this embodiment is exemplary only. A transfer assist blade 20 is shown engaged with the back of copy substrate 14, thereby pressing copy substrate 14 onto an image bearing member, such as photoreceptor belt ("PR") 10, as the copy substrate is driven in the direction of arrow 12 by pinch rollers 25. Corotron 54 charges copy substrate sufficiently to urge toner particles to transfer from PR 10 to copy substrate 14. Upon exiting the transfer section, corotron 56 provides an opposite charge, thereby aiding the detacking of copy substrate 14 from PR 10. In a typical embodiment, activation and deactivation of TAB 20 is induced by rotation of cam 212 which acts upon lever 200. TAB 20 is attached to the other end of lever 200. Spring 201 biases lever 200 and attached TAB 20 toward the deactivated position. A controller 221 cooperates with a leading and trailing edge sensor system comprised of light emitter 17 and sensor array 18. In particular, the controller 221 determines the timing for activating a stepper motor 220 that controls the rotation of cam 212 in order that TAB 20 be in contact the back of copy substrate 14 as near as possible to both the leading and the trailing edges of the substrate.

Another timing sequence for activation of TAB 20 involves cooperation between controller 221 and a location indicator 61 associated with the photoreceptor belt 10, rather than between the controller and the substrate edge sensor system 17 and 18. In this alternate timing sequence, a synchronizing sensor 58 detects when a location indicator 61 on the belt 10 passes the sensor location and relays a synchronization signal to controller 221. The location indicator 61 may be a hole in the PR 10. Since the rate of rotation or travel of PR 10 in the direction 12 is known, controller 221 is able to coordinate delivery of copy substrate 14 into contact with PR 10 with activation and deactivation of stepper motor 220 in order that TAB 20 contact copy substrate 14 near its leading and trailing edge. More details concerning the exemplary TAB system illustrated in FIG. 1 and the apparatus utilizing such TAB system can be found at U.S. Pat. No. 6,556,805, issued to Kuo, the disclosure of which is incorporated herein by reference.

Figure 2:
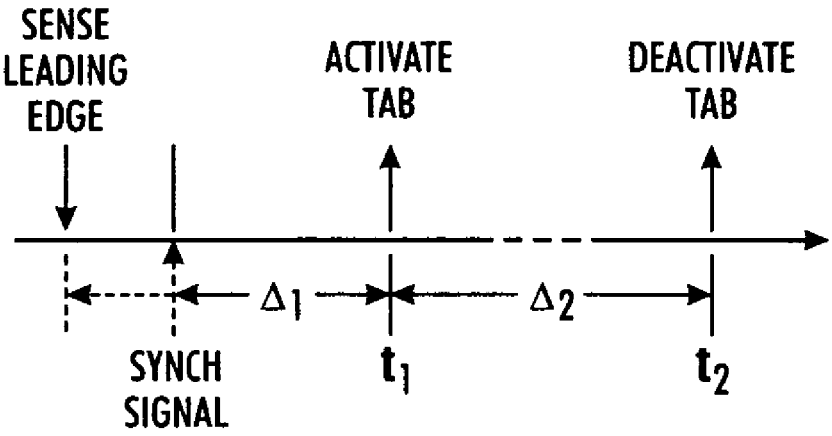
FIG. 2 is a graph of a transfer assist blade activation and de-activation sequence.

With both timing sequences, knowledge of the length of the substrate between the leading and trailing edges is required. Referring to FIG. 2, these timing sequences are illustrated graphically. When a copy or print cycle is requested, the PR belt 10 is activated and the belt operates in synchronization with the drive rollers 25 that pull the substrate 14 from the supply source. When the location indicator 61 reaches the synchronization sensor 58, a signal is sent to the controller 221 to set the timed sequence in motion. The distance that the substrate travels to the transfer zone and the travel speed in the direction 12 is known, so a pre-determined initial dwell value $\Delta_1$ is applied by the controller to delay the activation of the TAB 20 until a time $t_1$. Since the paper length is known, based on user input for instance, and the travel speed is known, then a second dwell $\Delta_2$ is applied by the controller to deactivate the TAB at a time $t_2$.

When the sensor array 18 is used to initiate the sequence, the leading edge signal from the array is fed to the controller 221 to initiate the TAB timing sequence. In this case, the initial dwell value $\Delta_1$ is measured from when the leading edge is sensed, as represented by the dashed line in FIG. 2, which may be a different real time than the issuance of the synchronization signal by the sensor 58. However, under either approach to initiating the TAB activation sequence, the dwell time $\Delta_2$ is the same, since it is based on the presumed substrate length and travel speed.

One difficulty with this activation sequence is that the true effective length of the substrate may vary due to paper tolerances, cut sheet length errors, registration errors as the substrate is extracted from the supply hopper, among other causes. Thus, when the trailing end of the substrate actually passes through the transfer zone, the TAB may have already been lifted, which diminishes the copy transfer at the trailing edge. Alternatively, the TAB may remain activated after the trailing edge has passed through the transfer zone, which can cause damage to the PR 10.

Thus, in one embodiment of a system and method for controlling a transfer assist blade, the second dwell $\Delta_2$ is modified as a function of the actual length of the substrate. The actual length of the substrate is determined indirectly by a trailing edge signal received from a substrate sensor, such as the sensor array 18. If the actual measured length varies from a presumed substrate length, the dwell $\Delta_2$ is either increased or decreased accordingly. Since the trailing edge is sensed at a location upstream of the TAB, the controller 221 has sufficient time to adjust the dwell $\Delta_2$ before the trailing edge reaches the transfer station and TAB 20.

Figure 3:
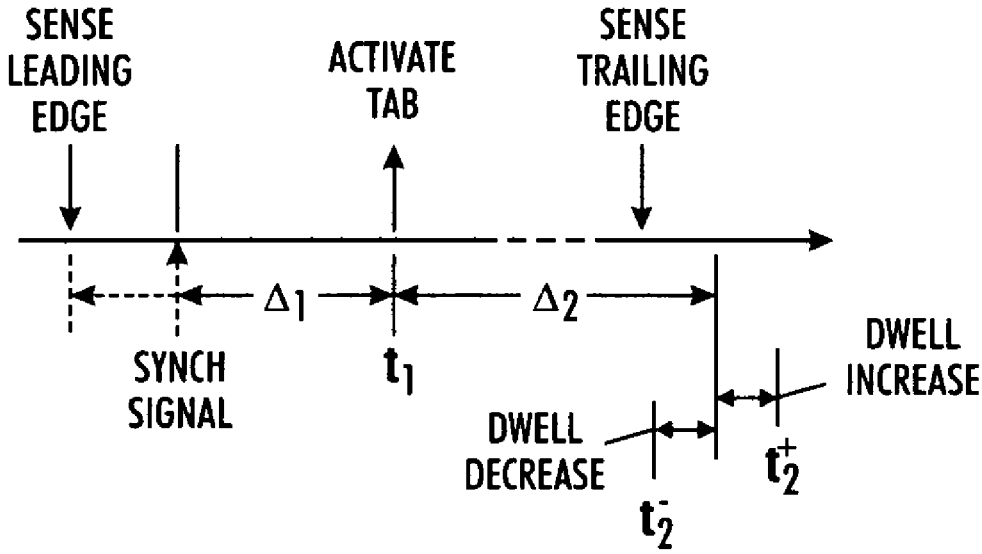
FIG. 3 is a graph of a transfer assist blade activation and de-activation sequence modified in one disclosed embodiment.

Thus, in accordance with this embodiment, the timing sequence may be implemented as shown in the graph of FIG. 3. The initial dwell $\Delta_1$ is determined in the same manner described above based on receipt of either the synchronization signal from sensor 58 or the leading edge signal received by the controller 221 from the sensor array 18. Once the timing sequence has been initiated by the controller 221, the controller will hold the TAB in contact with the substrate until the second dwell period $\Delta_2$ has expired. This second dwell period is associated with a nominal or assumed substrate length. In accordance with this embodiment, this nominal substrate length may be represented by a nominal time between when the leading and trailing edges of the substrate are sensed by the array 18, based on a known travel speed for the substrate. As the substrate is conveyed towards the transfer zone 54 and the TAB 20, the light array 17 and edge sensor 18 continuously monitors the substrate for the appearance of the trailing edge. Once the trailing edge signal has been received, the controller 221 determines the actual time between receipt of the leading edge and trailing edge signals. This actual time value is compared to the nominal time value (which has been based on an idealized substrate length). If this actual time value falls outside an acceptable band around the nominal time value (corresponding, for instance, to a +/−2 mm error in page length), then the controller applies the pre-determined nominal dwell time $\Delta_2$. However, if the actual measured time value between receipt of the leading edge and trailing edge signals is less than the nominal time value, the second dwell value $\Delta_2$ is decreased by the amount of this difference. Likewise, if the actual measured time value is greater than the nominal time value, the dwell value is increased by that time difference. In the former case, the decrease in dwell value is because the substrate is shorter than the expected nominal length, which means that the TAB 20 must be lifted or de-activated earlier in the timing sequence than nominally expected. The latter case arises when the substrate is longer than expected, so that the TAB must stay in contact with substrate longer than expected.

Figure 4:
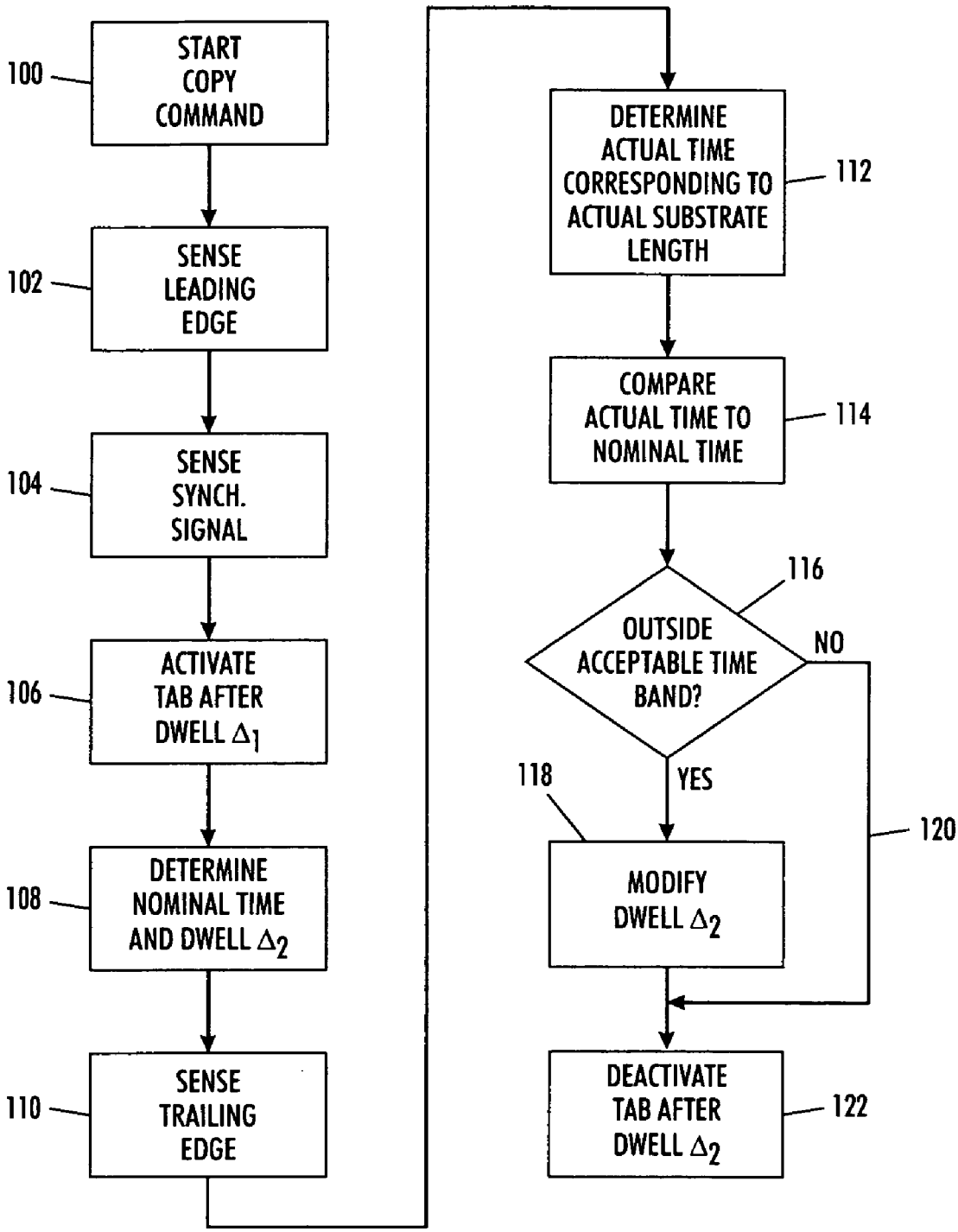
FIG. 4 is a flowchart of operational commands that may be implemented by a microprocessor to achieve the sequence depicted in the graph of FIG. 3.

The controller 221 includes a microprocessor that implements a series of commands according to the flowchart shown in FIG. 4. After a "start copy" command is received at step 100, the leading edge of the substrate is sensed as it passes the sensor array 18. The PR belt synchronization signal is received from the sensor 58 in step 104 to initiate the timing sequence shown in FIG. 3. It is understood that the two steps 102 and 104 may be reversed in order or may occur substantially simultaneously, depending upon the locations of the sensor array 18 and the location indicator 61 relative to the transfer zone 54 and TAB 20 when the "start copy" command is received by the controller 221.

Once the synchronization signal has been received and the timing sequence initiated, the controller issues a command in step 106 to activate the TAB 20 after the initial dwell time $\Delta_1$. Of course, this initial dwell time corresponds to the amount of time it will take the leading edge of the substrate to reach the transfer zone once the synchronization signal has been received. It is understood that this synchronization signal may be used by the controller to control the pinch rollers 25 feeding the substrate to the transfer zone in order to maintain the proper synchronization between the travel of the substrate and the activation of the TAB 20 and transfer corotron 54.

In the next step 108, the nominal length of the substrate is ascertained based on an input to the controller. For instance, the machine operator may select a particular sheet length for a copy. This nominal pre-determined substrate length corresponds to a nominal second dwell value $\Delta_2$. In the illustrated embodiment, this second dwell value is measured from the end of the first dwell period—i.e., after the TAB has been activated. Alternatively, the second dwell value $\Delta_2$ may be measured from receipt of the synchronization signal. In the former case, a dwell counter read by the controller 221 must be reset after the first dwell period times out. In the alternative approach the dwell counter can run continuously while the controller reads the dwell counter and compares it to the first and second dwell values $\Delta_1$ and $\Delta_2$.

In step 108, the nominal length of the substrate is also correlated to a time value between when the leading and trailing edges are sensed. Since the travel speed of the substrate is known and substantially constant, the nominal expected length of the substrate (based on the user input, for instance) can be directly correlated to a nominal time value.

As the substrate is conveyed through the transfer zone, the sensor array 18 is continuously polled by the controller 221 to determine whether the trailing edge of the substrate has been sensed in step 110. Once the trailing edge has been sensed, the actual time difference between receipt of the leading edge and trailing edge signals is determined in step 112. Again, since the travel speed of the substrate is known, this time difference corresponds to the actual length of the substrate. Since the sensor 18 is upstream of the TAB 20, this actual length determination is made by the controller 221 in advance of passage of the trailing edge through the transfer station.

The actual time difference between leading and trailing edge is compared to the nominal time value for the expected substrate length in step 114. More specifically, the actual time difference is compared to a time range centered at the nominal time value, which constitutes, in essence, a tolerance band around the nominal substrate length. In a specific embodiment, a length discrepancy of +/−3 mm is acceptable, meaning that the TAB 20 may be retracted 3 mm before the trailing edge or 3 mm after the trailing edge of the substrate has passed the transfer zone. The result of this comparison in step 114 may be a time error value equal to the actual time subtracted from the nominal time. This time error may then be compared to the acceptable tolerance band in step 116. If the time error falls within that band, then no change in the second dwell time is required and control passes to branch 120.

On the other hand, if the timer error calculated in step 114 falls outside the acceptable band, then the dwell value $\Delta_2$ is modified in step 118. The dwell value is modified by the amount of the time error, whether that error is positive or negative. If the time error is negative, the actual measured time period between leading and trailing edge is less than the expected time period for the nominal substrate length. In this case, the dwell $\Delta_2$ is reduced because the substrate is shorter than expected. Conversely, if the time error is positive (i.e., the measured time is greater than the expected time period), the substrate is longer than expected so the dwell time $\Delta_2$ must be increased to keep the TAB on the substrate longer.

In accordance with the described embodiments, the transfer assist blade 20 is activated only when there is substrate to operate on. In other words, the controller 221 interactively and automatically determines whether the substrate is shorter or longer than expected. These embodiments do not require modification of the existing hardware or electronics of the print engine. It is understood that the controller 221 issues an appropriate command to control the movement of the transfer assist blade 20. In the illustrated embodiment, the TAB is lowered and raised by a cam 212 driven by a stepper motor 220. The controller 221, thus, can issue appropriate start-stop and forward-reverse commands to the stepper motor controller based on the timing sequence depicted in FIG. 3. Other TAB control mechanisms may require other types of commands to activate or de-activate TAB, as is known in the art.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An apparatus for assisting in the transfer of an image from an image bearing member onto a copy substrate, comprising:

an image bearing member carrying an image to be transferred;

a feed mechanism for feeding a copy substrate to said image bearing member;

a transfer assist mechanism arranged adjacent said image bearing member and movable to an activated position bearing on the substrate to maintain the substrate in contact with said image bearing member to assist in transferring the image thereto, and to a de-activated position that does not maintain the substrate in contact with said image bearing member;

a sensor for generating a signal in response to passage of the leading edge and the trailing edge of the substrate before such edge is adjacent said transfer assist mechanism; and a controller operable to direct said transfer assist mechanism to move to said activated position and to direct said transfer assist mechanism to move to said de-activated position after a de-activation dwell time, said de-activation dwell time being at least initially a nominal dwell time based on an expected length of the substrate from its leading edge to its trailing edge, said controller further operable to change the de-activation dwell time from said nominal dwell time in response to receipt of a signal from said sensor generated in response to passage of the trailing edge of the substrate.

2. The apparatus for assisting in the transfer of an image of claim 1, wherein:

said controller is operable to ascertain an actual length of the substrate based on signals from said sensor indicating passage of the leading edge and the trailing edge; and said controller is operable to compare the actual length to the expected length to determine the magnitude of the change to the de-activation dwell time.

3. The apparatus for assisting in the transfer of an image of claim 2, wherein said controller is operable to increase the de-activation dwell time if the actual length is greater than the expected length and to decrease the de-activation dwell time if the actual length is less than the expected length.

4. The apparatus for assisting in the transfer of an image of claim 1, further comprising a synchronization sensor operable to generate a synchronization signal as a function of the position of the image bearing member, wherein said controller is operable to direct said transfer assist mechanism to move to said activated position after an activation dwell time measured from receipt of said synchronization signal.

5. The apparatus for assisting in the transfer of an image of claim 4, wherein said controller is operable to direct said transfer assist mechanism to move to said de-activated position after said de-activation dwell time measured from the end of said activation dwell time.

6. An apparatus for assisting in the transfer of an image from an image bearing member onto a copy substrate, comprising:

a rotating photoreceptor belt carrying an image to be transferred, said belt including a location indicator;

a feed mechanism for feeding a copy substrate to said image bearing member;

a transfer assist blade arranged adjacent said image bearing member and operable in an activated position to bear on the substrate to maintain the substrate in contact with said image bearing member to assist in transferring the image thereto;

a mechanism for moving said transfer assist blade between said activated position in response to an activation signal and a de-activated position in which said transfer assist blade does not maintain the substrate in contact with said image bearing member in response to a de-activation signal;

a synchronization sensor operable to generate a synchronization signal in response to the passage of said location indicator as said photoreceptor belts rotates;

a sensor for generating a leading edge signal in response to passage of the leading edge and a trailing edge signal in response to passage of the trailing edge of the substrate before such edge is adjacent said transfer assist blade; and a controller operable to transmit said activation signal to said mechanism after a predetermined first dwell time following receipt of said synchronization signal and to transmit said de-activation signal to said mechanism after a predetermined second dwell time later than said first dwell time, said controller further operable to determine the actual length of the substrate using said leading and trailing edge signals and to compare said length to a predetermined nominal length and to increase said second dwell time if said actual length is greater than said nominal length or to decrease said second dwell time if said actual length is less than said nominal length.

7. A method for operating a transfer assist mechanism to bear on a substrate passing over an image bearing member for transferring an image onto the substrate, comprising:

activating the transfer assist mechanism to bear on the substrate;

determining a nominal dwell time for de-activation of the transfer assist mechanism as a function of an expected length of the substrate;

sensing an actual length of the substrate as it is conveyed to the image bearing member; and changing the dwell time for de-activation as a function of a comparison between the actual length and the expected length.

8. The method for operating a transfer assist mechanism of claim 7, wherein the transfer assist mechanism is activated in response to a synchronization signal generated to synchronize movement of the substrate to movement of the image bearing member.

9. The method for operating a transfer assist mechanism of claim 8, wherein the transfer assist mechanism is activated after an activation dwell time measured from receipt of the synchronization signal.

10. The method for operating a transfer assist mechanism of claim 7, wherein the actual length of the substrate is sensed by sensing passage of the leading and trailing edges of the substrate.

11. The method for operating a transfer assist mechanism of claim 10, wherein the dwell time for de-activation is increased if the actual length is greater than the expected length and is decreased if the actual length is less than the expected length.

12. The method for operating a transfer assist mechanism of claim 10:

wherein the actual length of the substrate is determined by the time period between the sensed passage of the leading and trailing edges; and the expected length of the substrate corresponds to a nominal time period for passage of the leading and trailing edges of an expected length of the substrate.

* * * * *